US006810816B2

(12) United States Patent
Rennard

(10) Patent No.: US 6,810,816 B2
(45) Date of Patent: Nov. 2, 2004

(54) AMMUNITION TRACKING SYSTEM

(76) Inventor: Carl J. Rennard, 16 Red Brook Crossing Rd., Lincoln, RI (US) 02865

( * ) Notice: Subject to any disclaimer, the term of this patent is extended or adjusted under 35 U.S.C. 154(b) by 0 days.

(21) Appl. No.: 10/444,786

(22) Filed: May 24, 2003

(65) Prior Publication Data

US 2003/0217665 A1 Nov. 27, 2003

Related U.S. Application Data

(63) Continuation-in-part of application No. 09/875,479, filed on Jun. 6, 2001, now abandoned.
(60) Provisional application No. 60/209,788, filed on Jun. 7, 2000.

(51) Int. Cl.[7] ..... F42B 5/26
(52) U.S. Cl. ..... 102/430; 102/203; 102/473; 102/501; 283/81; 283/86
(58) Field of Search ..... 102/293, 430, 102/473, 501; 283/81, 86

(56) References Cited

U.S. PATENT DOCUMENTS

| | | | | | |
|---|---|---|---|---|---|
| 1,275,669 | A | * | 8/1918 | Forbes | 102/513 |
| 1,632,156 | A | * | 6/1927 | Wiley | 102/501 |
| 1,650,908 | A | * | 11/1927 | Ramsey | 42/106 |
| 1,887,324 | A | * | 11/1932 | Pocoroba | 40/629 |
| 4,150,624 | A | * | 4/1979 | Hammond | 102/293 |
| 4,519,522 | A | * | 5/1985 | McElwee | 221/13 |
| 4,765,223 | A | * | 8/1988 | Beckmann | 89/33.04 |
| 5,020,958 | A | * | 6/1991 | Tuttobene | 414/281 |
| 5,177,318 | A | * | 1/1993 | Martinez et al. | 89/46 |
| 5,200,573 | A | * | 4/1993 | Blood | 102/501 |
| 5,406,068 | A | * | 4/1995 | Nusbaum | 235/493 |
| 5,485,789 | A | * | 1/1996 | Collier | 102/501 |
| 5,511,483 | A | * | 4/1996 | Griffin, Jr. | 102/501 |
| 5,646,365 | A | * | 7/1997 | Collier | 102/501 |
| 5,685,100 | A | * | 11/1997 | Atchison | 42/1.01 |
| 5,698,816 | A | * | 12/1997 | Roxby | 102/516 |
| 5,758,446 | A | * | 6/1998 | Atchison | 42/78 |
| 6,209,459 | B1 | * | 4/2001 | Kaufman et al. | 102/439 |
| 6,293,204 | B1 | * | 9/2001 | Regen | 102/430 |
| 6,432,559 | B1 | * | 8/2002 | Tompkins et al. | 428/624 |
| 6,612,063 | B1 | * | 9/2003 | Sigg | 42/106 |

FOREIGN PATENT DOCUMENTS

| | | | |
|---|---|---|---|
| EP | 0282394 | * | 1/1988 |
| GB | 2295001 | * | 5/1996 |

* cited by examiner

*Primary Examiner*—Jack Keith
*Assistant Examiner*—John Richardson
(74) *Attorney, Agent, or Firm*—Robert J. Doherty

(57) ABSTRACT

A tracking system for ammunition cartridges where the cartridge casings are provided with serial indicia on an inside surface such that spent casing found at a crime scene can be tracked to the purchaser of the ammunition via a machine scannable system.

2 Claims, 10 Drawing Sheets

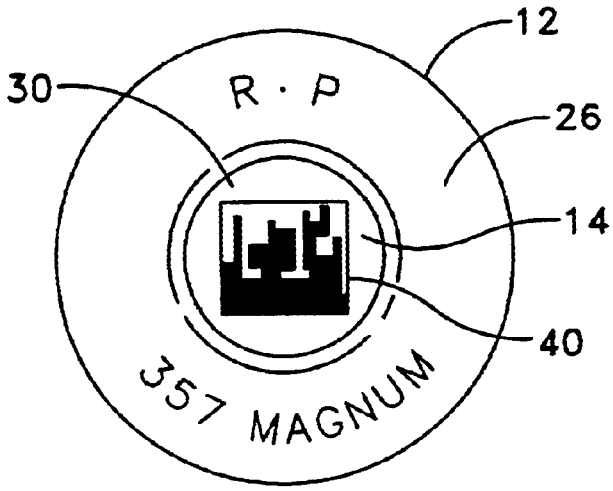
FIG. 3
FIG. 4
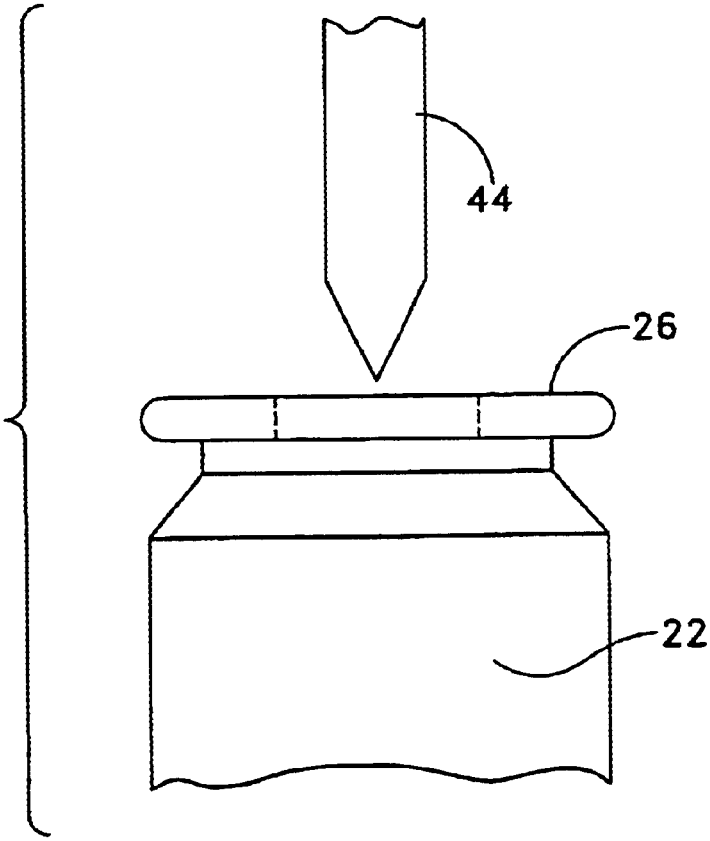

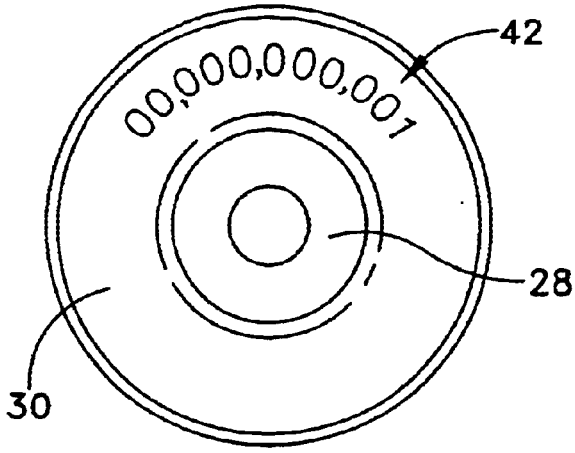
FIG. 5
FIG. 6
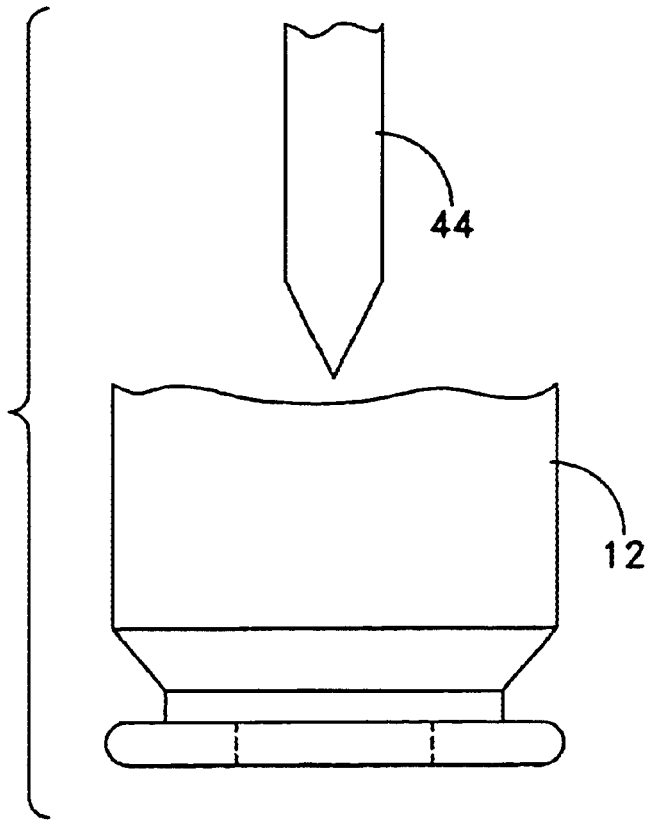

AMMUNITION TRACKING SYSTEM

This application is a Continuation-In-Part of application Ser. No. 09/875,479 filed Jun. 6, 2001 now abandoned which application in turn incorporates Provisional Patent Application No. 60/209,788 filed Jun. 7, 2000.

BACKGROUND OF THE INVENTION

This invention relates to small arms ammunition and more particularly to a system that will enable investigative authorities to better solve crimes involving the discharge of firearms utilized with such ammunition. When firearms are utilized in the commission of a crime, the crime scene often includes spent ammunition casings. It would thus be desirable to be able to link those crime scene casings to the person or persons committing such crime. Presently there are anti-diversion tracking systems referred to as ADTS which allow manufacturers to trace products using overt and covert technologies from point of manufacture throughout the distribution chain. For instance, scannable indicia, codes including conventional bar codes can be incorporated into labels of many products such as cosmetics, shampoos and the likes in order to be able to trace the manufacturing and purchase history of such articles for purposes of recall and policing unauthorized distribution. Accordingly, it would be desirable if the general principles of such product tracking systems could be utilized and modified to enable the tracking of ammunition cartridges such that crime scene firearms' casings could be traced to the last authorized purchaser of the ammunition cartridge from which the casing was part of.

SUMMARY AND OBJECTS OF THE INVENTION

It is, accordingly, an objective of the present invention to modify such anti-diversion tracking systems in a unique and unobvious manner so as to achieve crime scene identification of spent ammunition casings. Such is accomplished by the present ammunition tracking system which is designed to serialize ammunition cartridges in such a fashion as to be able to trace them from manufacturer, to distributor, to the retailer and finally to the final consumer or purchaser via a network of computer terminals at the point of purchase. Such system places a number or other unique identification on an interior surface of the cartridge casing which indicia will be still visible after the cartridge is fired such that investigative personnel can visually identify such number or other indicia and utilize such to trace the ammunition to the purchaser and additionally place an optically readable code on the shell casing exterior surface such that it may be read by high speed optical scanning equipment so as to, in part, establish a manufacturing and distribution history of such cartridge. Such system would thus allow casings found at crime scenes to be traced to the person who purchased them greatly enhancing the ability of law enforcement agencies to quickly and confidently solve crimes. These and other objectives of the present invention are accomplished by a small arms ammunition cartridge including a casing having a cylindrical body having inner and outer wall surfaces and opposed top and bottom ends wherein said bottom end is closed by a bottom wall in turn having a top inner surface and a lower outer surface, an explosive charge contained in the casing, a bullet attached to the top of the casing body and means for initiating the explosive charge to fire the bullet, the improvement comprising a machine readable code on at least one of the outer wall surfaces of said casing and a unique indicia visible by the human eye on at least one of said inner surfaces of said casing, said indicia identifying a particular casing and said code including identification of said indicia.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 3 is a bottom plan view on an enlarged scale of the cartridge shown in FIG. 1;

FIG. 4 is a view of the interior portion of the shell casing taken along the line 4—4 of FIG. 2;

FIG. 5 shows a laser-marking device imparting a machine-readable code, e.g., in data matrix format, on the bottom of the casing shown in FIG. 1 and particularly on the outside surface of the primer portion thereof;

FIG. 6 shows a similar laser-etching device that is capable of imprinting a serialized number on the upper surface of the inside bottom wall of the cartridge casing;

DETAILED DESCRIPTION OF THE INVENTION

Figure 1:
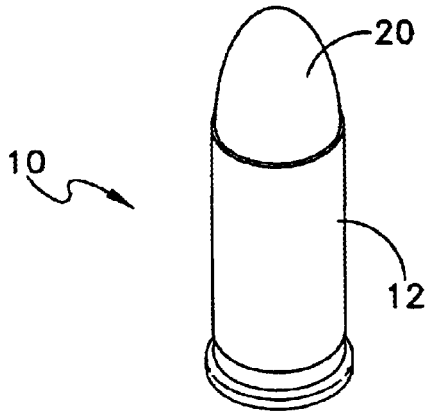
FIG. 1 shows a single unit of small arms ammunition generally referred to as a cartridge.
Figure 2:
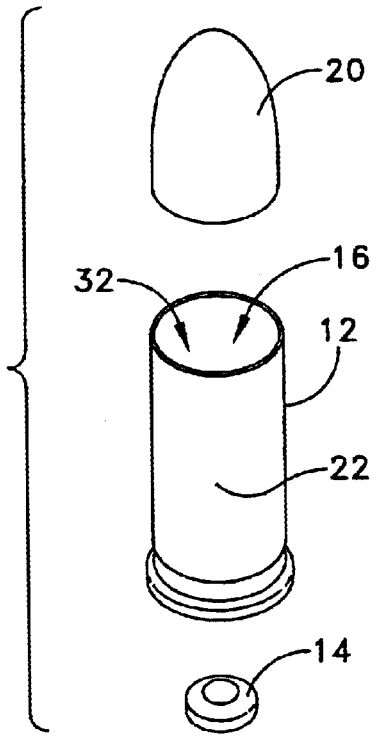
FIG. 2 shows the cartridge shown in FIG. 1 in a disassembled format showing the component parts thereof commonly referred to as an "exploded" view.

Several unique manners of achieving the results of the present invention have been devised. In one method (Method No. 1) the flat metal sheet stock (not shown) in the raw materials stage that is destined to be formed into firearm cartridge shells (casings) may be provided with a laser reactive coating. Such coating may be applied to both sides of the stock wherein one side of the stock is destined to become the inside of the ultimately formed cartridge casing and the other side forming the outside of such cartridge casing. This coating will enable an optical laser to mark the stock on both opposed surfaces or at least the surface destined to become the inside of the cartridge as by etching or burning through selected areas thereof. This etching would take place at predetermined intervals along the stock sheet metal to correspond to those special areas, which will bear the indicia on the ultimately formed cartridge casing. Preferably the indicia on the cartridge shell interior should be visible with the naked eye by the crime scene investigator. The indicia destined to become the desired outside portion of the cartridge can be in code, that is, machine-readable, and as small as one-millimeter square (see FIG. 3).

Coding by such laser etching of the top and bottom surfaces of the stock can occur simultaneously with impartation of matching numbers either visibly readable or encoded. Such a tracking number can take the form of a multiple digit number, e.g., a twelve digit number which would provide the capability of tracking up to 999,999,999, 999 individual cartridges per year. Following years could begin with a letter prefix (Example: A99,999,999,999). This method will provide a system wherein no two cartridges could have the same tracking number for decades to come. In addition, prefixes or suffixes of numbers, letters or other indicia could be provided for each different manufacturer.

In this first method of forming cartridge casings from stock already provided with indicia as by the above-described laser etching process, the top code or tracking number will become the inside of the cartridge which will enable humanly readable tracking of such number and the bottom code will become the outside of the cartridge casing which will enable such to be machine readable in data matrix format ECC200. Such data matrix code format is, in essence, a two-dimensional barcode and is utilized as the marking code of choice of many industries such as computer chip manufacturers to mark their small manufactured components. There are also a number of other barcodes including one-dimensional barcodes that may be utilized with this invention so as to not exclude a symbology that may be suited for this application including preprinted labels to visibly readable inks—all of which including the laser etchable coding must be environmentally resistant to the condition of use, that is, the indicia applied to the cartridge shell's inside surface must be capable of withstanding the explosive and burning forces of the propellant upon firing, and the surface destined to become the outside surface of the cartridge must be able to withstand environmental conditions, e.g., temporary high temperature and normal abrasion contact.

In a second method of coding, the cartridge primer, which may be manufactured on site or supplied by a vendor, is coated with a laser reactive material or dark colored finish. The laser to produce a machine-readable code, e.g., data matrix format ECC200, will remove this micro coating.

As the cartridges are assembled, the primer is placed in the bottom and seated into the cartridge casing. Prior to injecting the explosive charge, e.g., gunpowder, into the cartridge casing, a machine vision system will read and decode the data matrix code previously formed by the laser on the primer. This information will then be translated by computer software and sent to an online laser that will print the humanly readable equivalent in two probable locations. These locations are inside the edge of the cartridge casing or on the bottom inside surface of the cartridge casing. This number will be used to locate the purchaser of the cartridge if the cartridge is involved in a crime. In this method, it would only be necessary to apply a laser etchable coating to that surface of the stock destined to form the inside surface of the cartridge or apply such coating to that surface after the formation of the cartridge casing. The cartridge manufacturing process will continue as the explosive charge, e.g., gunpowder, is added and the projectile is seated and crimped to the cartridge casing to form the completed ammunition cartridge.

A third method applies the desired indicia after the primer has been seated into the cartridge casing but before the cartridge is filled with gunpowder. Two (2) lasers—one firing a data matrix on the outside bottom of the primer and the second laser printing the humanly readable equivalent inside the rim or on the inside bottom of the cartridge are utilized. It is also possible to print, etch or otherwise apply the machine-readable code to the outside bottom surface of the cartridge casing, that is, that surface surrounding the bottom surface of the primer rather than on the primer itself. As stated before, an ink jet printer could also print the machine-readable data matrix.

In the example set forth above, the completed ammunition cartridge 10 is formed from a cartridge casing or shell 12, a primer 14 usually a percussion activated explosive charge, the primary explosive charge 16, e.g., gunpowder, that is placed in the casing and the projectile bullet 20 which is attached to the casing after the gunpowder is inserted. The casing includes an elongated cylindrical body 22 open at the top end 24 thereof and including a smaller opening (not shown) at the bottom wall 26 thereof. The cartridge primer 14 is generally in the form of a circular disc having opposed upper 28 and lower surfaces 30 and is adapted to be crimped or otherwise attached to the casing bottom wall 26 while positioned in the opening thereof. The machine-readable bar matrix code is referred to by the reference numeral 40 while the indicia on the inside surface of the casing by the reference numeral 42. The commercially available lasers are referred to by the reference numeral 44.

The Scanning and Labeling Process

As an example, the cartridges are then placed in a holder with the primer 14 facing up, which would likely be an automated process. Before the holders with the coded cartridges are placed and sealed in the retail package, a machine vision system will read and record the identity of each cartridge. Such optical vision systems that are capable of reading and decoding as many as 100 individual data matrix codes at simultaneously are commercially available. The software within the ATS (Ammunition Tracking System) system will then identify, process and assign the cartridges a unique package number. The package number is then printed onto the side of the retail package 48, e.g., via an ink jet printer. The printed format could be a number of different types of linear barcode 50 plus the humanly readable equivalent. This unique package number may also be used to automatically print and apply the label. There is also the option of using a preprinted label. Such preprinted label would be applied to the package after the package has been scanned by the machine vision system. All labels will then be linked to the cartridge identities inside the package. This number will later be used to track to the ultimate consumer.

Figure 7:
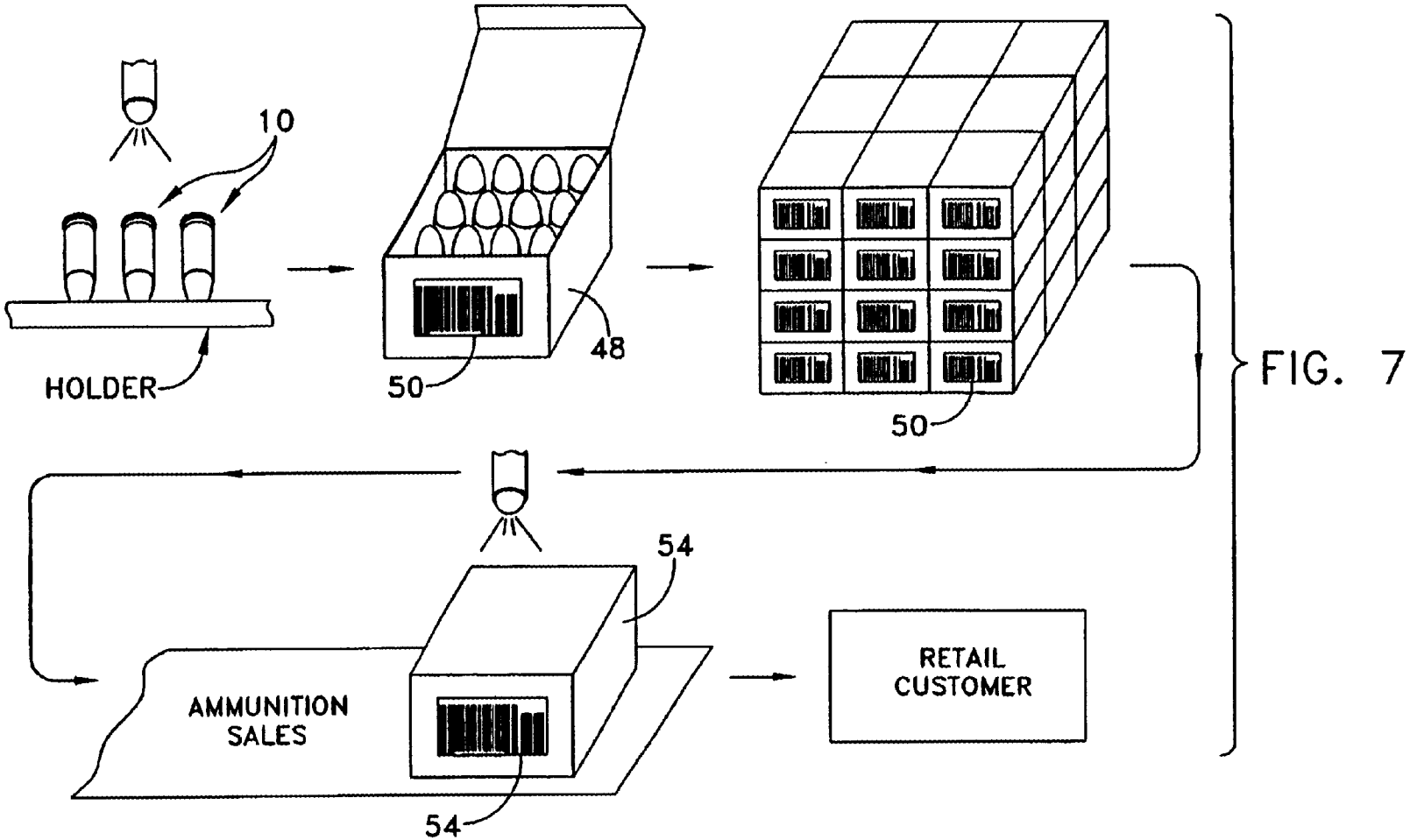
FIG. 7 is a stylized view showing the progression of individual cartridges to packages thereof to a case and at each stage of the process being machine read for the purposes of the present invention including a stylized view of the interior of an ammunition or gun store in which the outside barcode of an individual package of cartridges is scanned and information taken as to the identity, etc. of the retail customer purchasing such.
Figure 8:
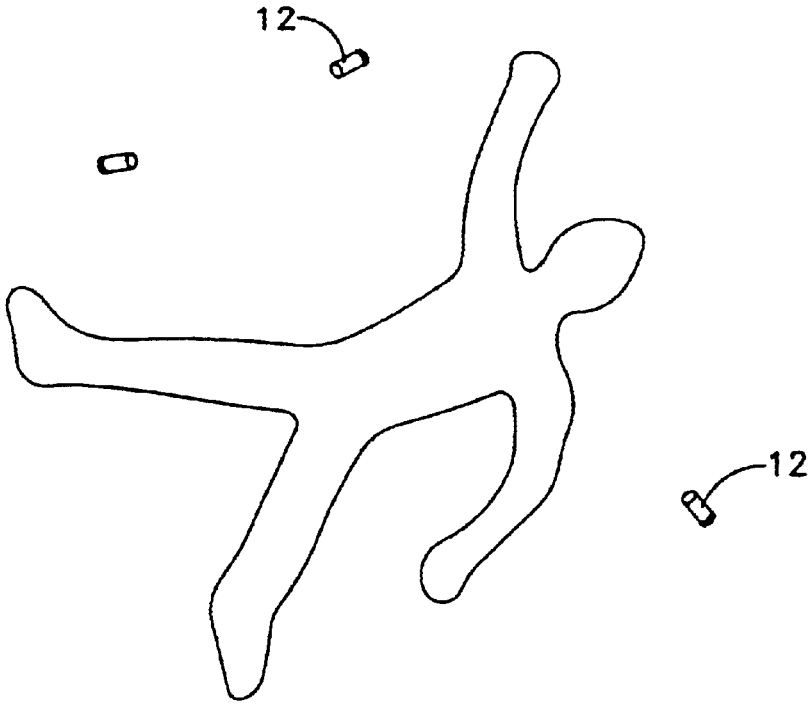
FIG. 8 is a plan view of a crime scene.

The building of shipping cases is also illustrated in FIG. 7. As the packages of completed cartridges are being packed, the package barcode 50 numbers are then scanned and the shipper case is built. The Ammunition Tracking System (ATS) software program will store all package identifications being placed in the case. After a preset number of packages have been reached to complete the case, a linear barcode 52 will be printed and applied to the case 54. This process may be done automatically. The Ammunition Tracking System is used to link this shipper case barcode and all the cartridges contained within the case to the distributor or retailer during shipment from the manufacturer.

A palette is built in the same fashion. After a preset number of cases have been placed on a palette, the Ammunition Tracking System will assign and print a palette label. This palette label when scanned will link every case, package and cartridge's identification to its destination.

Figure 9:
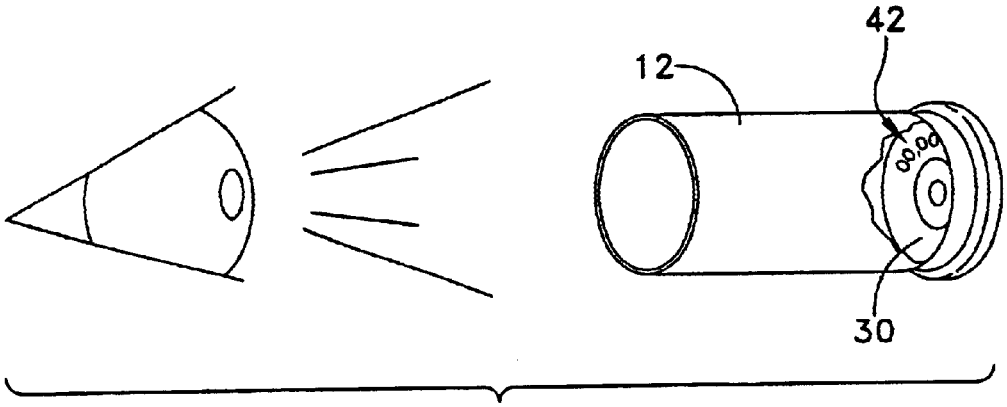
FIG. 9 is a slightly enlarged partial interior portion of a shell casing in which the indicia imparted on the upper inner surface thereof is visible by the naked eye of the crime scene investigator.
Figure 10:
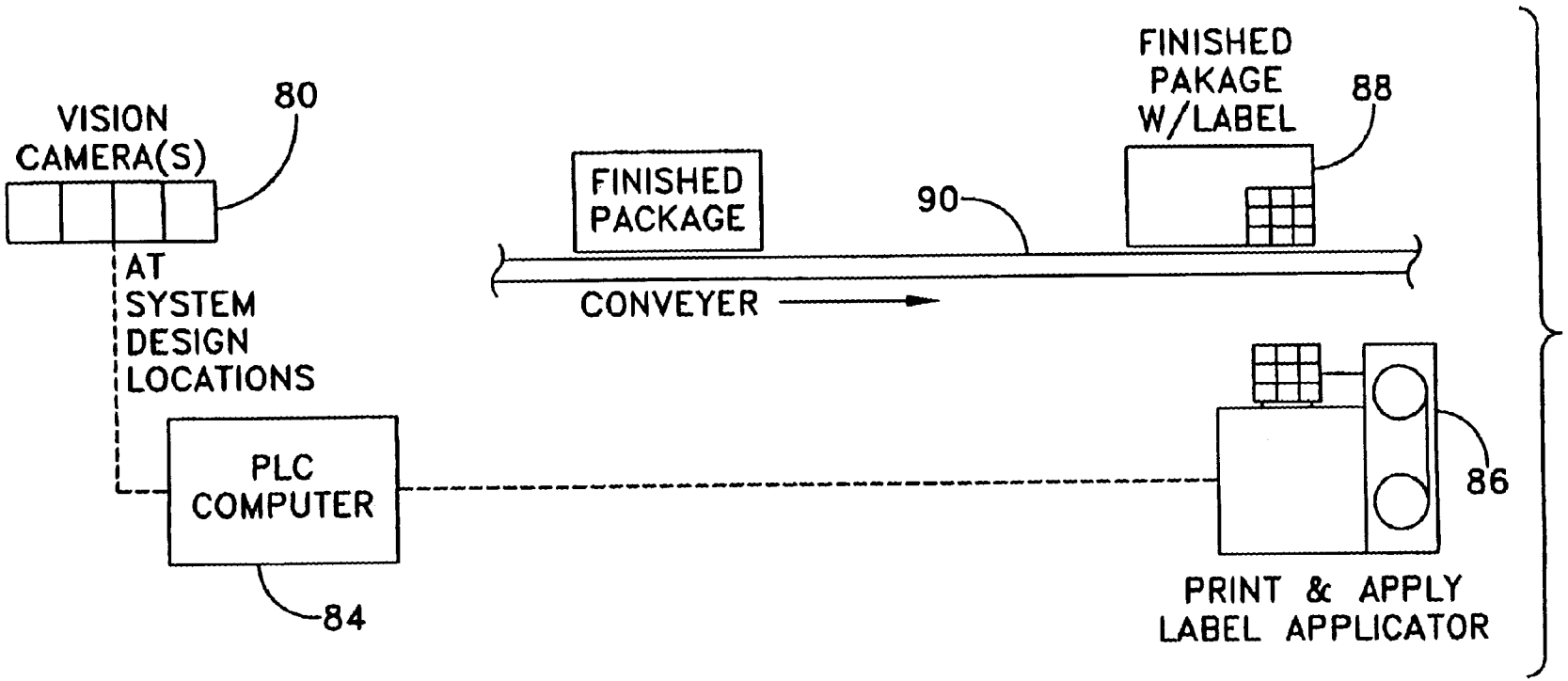
FIG. 10 is a stylized view of an overall system for reading coded cartridges and handling such information.

FIGS. 9 and 10 show in diagram format the manner in which the Ammunition Tracking System tracks the ammunition. When ammunition is shipped to a distributor or retailer, the manufacturer will normally generate an order and picking list from their existing system. Using a data collection device equipped with ammunition tracking software, the manufacturer will enter the retailer or distributor identification number followed by the invoice number. (These steps are covered in depth by trained ammunition tracking personnel.) The order picker is then prompted to scan the palettes and/or cases selected to fill said order. When the order is complete, the same procedure will be repeated to fill the next order and so on. Scanning a palette or case will immediately link those particular cartridges in that palette or case to the receiving retailer/distributor. At the end of the day or any scheduled time/quantity interval, the data collectors are uploaded to the central database server of the Ammunition Tracking System that will continually update this offsite central database. The distributor shipping to the retailer would use the same shipping method utilized by the manufacturer to ship to a distributor.

How the Ammunition Tracking System is used to track cartridges from the retailer to the consumer is as follows:

When the retailer sells any ammunition cartridges to a customer, the retailer will enter via the Ammunition Tracing System's direct Internet link or onsite computer, the package identification number and/or scan the tracking barcode 50 printed on the side of the package. The system will prompt the retailer to enter the customer's name, state of residence and driver's license number along with any other pertinent information required by law. With the process complete, the cartridge identification numbers are now linked to the ultimate customer along with date, time and retailer of record. In the case of the direct online Internet connection, the transaction is instantly recorded. In the case of the retailer using an onsite computer to collect the transaction data, this computer will be polled at the end of each business day or other interval, and all transactions will be uploaded to the centralized database. The preferred system would be the instant online hookup.

Tracking Ammunition Involved in a Crime

Ammunition found at crime scenes are decoded by visibly looking into the interior bottom or side of the spent cartridge casing 12. This humanly readable number is entered into the Ammunition Tracking System's central database by law enforcement agencies at the scene or some central location linked by telephone or computer. Immediately, the ammunition is then traced back to the customer who purchased the ammunition along with the date and retailer of record as well as all the pertinent information collected. This process may be accomplished in two ways: 1) because the data is instant and in a humanly readable form, officials at the scene are able to radio the cartridge identification number and thereby have a very strong lead within a very short time period; 2) the cartridge casing would be returned to the lab to perform the data trace.

The above-explained systems for utilizing the markings applied to an ammunition cartridge casing enable the objectives of the present invention to be carried out in a cost effective, relatively simple manner. A key feature of the invention is not only the broad concept of marking cartridges for the purpose of tracing them to a purchase source, but also the concept of including a serial identification number on a surface of the cartridge casing which is hidden from the user and only visible after the bullet is fired from a gun and that any attempt to alter such interior indicia would normally destroy the usefulness of the product.

Also in order to enable the retrieval of stored information relative to where, when and to whom sold and the like, a practical system to read, decode, store, label and track small arms cartridges which are coded in the various manners and locations as set forth in the present application is necessary. Other coding designs or patterns such as those set out in U.S. Pat. No. 6,293,204 issued Sep. 25, 2001 to Regen may be utilized as well and in that regard the Specification of such Regen patent is hereby incorporated into the subject application by specific reference thereto.

One of the critical aspects of a practical system, as described herein and with particular reference to the explanation of the FIG. 7 reading, decoding, labeling and tracking of small arms ammunition casings, is the manner in which the casings are initially read such that the code applied thereto regardless of the particular code utilized can be inputted into a useful and retrievable data base. Five alternate reading systems are set forth hereinafter by reference to FIGS. 10 thru FIG. 14.

With regard to the first reading system, specific reference is made to FIG. 10 which functions with a single camera and wherein the labeling system utilizes a data matrix coded in the primer. After the ammunition (cartridges) has been coded but prior to being put into the finished retail package, the cartridges are placed into the inner box holder as shown in FIG. 7 with the primers face up and would likely be an automated process. See also FIG. 10 where a machine vision system will read and record the identity of each cartridge. Such optical vision systems are capable of reading and decoding as many as 100 individual codes simultaneously as the cartridges pass under the camera and into the retail package. The software within the system will then process and assign the cartridges within the package a unique tracking number. The unique number can then be printed onto the side of the retail package via an ink jet printer. The printed format could also be of an automated print and apply label in either a liner barcode or a two-dimensional barcode such as Data Matrix or PDF 417. All labels will be linked to the cartridge identities inside the package. These numbers will later be used to track to the ultimate consumer.

In each of the various reading systems referred to herein, the vision cameras are tailored to each type of code system and handling format, however, the FIG. 10 drawing outlines the overall system wherein reading of the cartridges takes place at the vision or cameras' location 80 and such data supplied to the PLC computer 84 which, in turn, provides the information input to a print and label applicator device 86 where the finished retail package 88 is moved along a conveyor 90 and a label provided with the appropriate information for that package received from the PLC computer is applied.

Presently, there are data storage programs capable of storing massive amounts of data that will be required in such systems as to be described hereinafter.

Each system described within this document will employ the latest in barcode label and OCR (optical character recognition) scanning and decoding principles. All systems abide by the basic barcode scanning and decoding principles of proper lighting and contrast. Frequently used terms: OCR—Optical Character Recognition; PLC—Programmable Logic Control; and CCD—Charged Couple Device.

Figure 11:
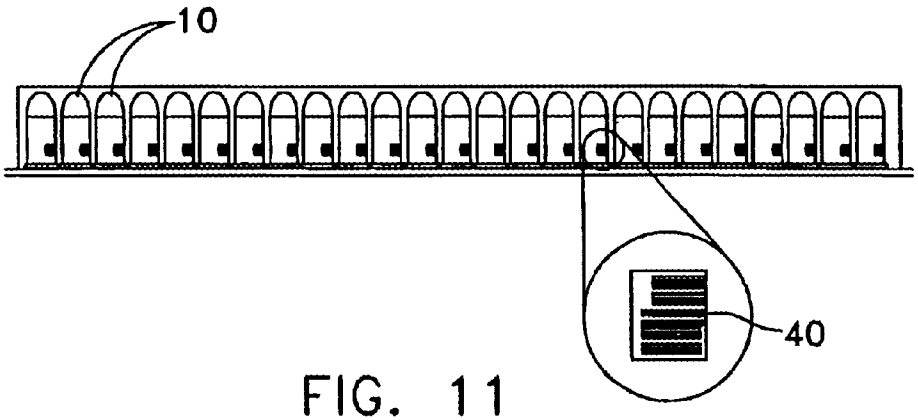
FIG. 11 is a stylized top plan view of a second system for reading coded cartridges.
Figure 12:
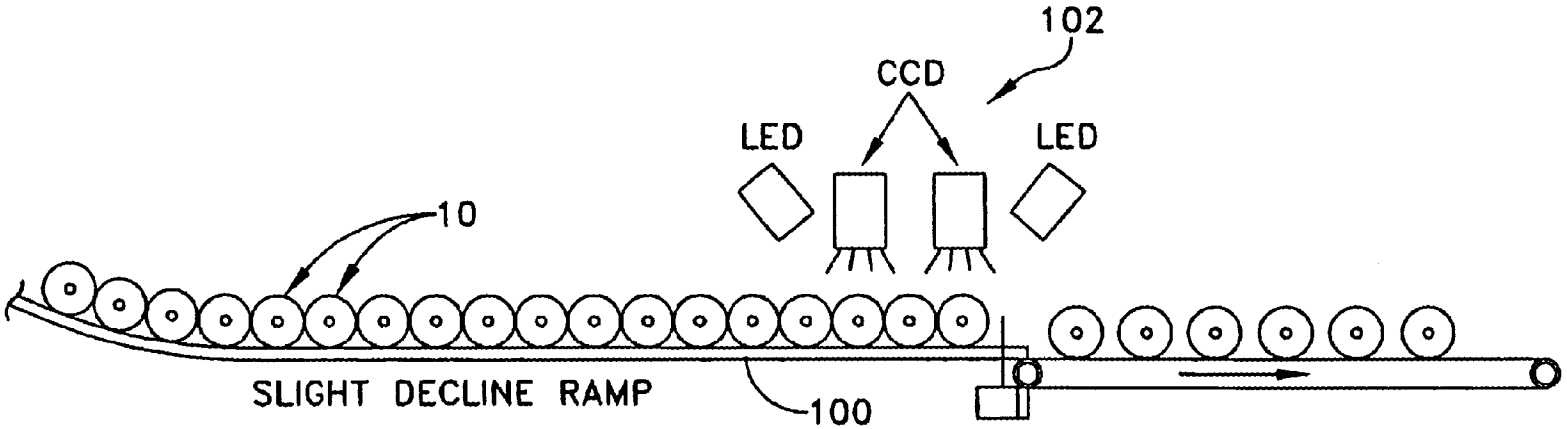
FIG. 12 is a stylized elevational view of such second system for reading coded cartridges.
Figure 13:
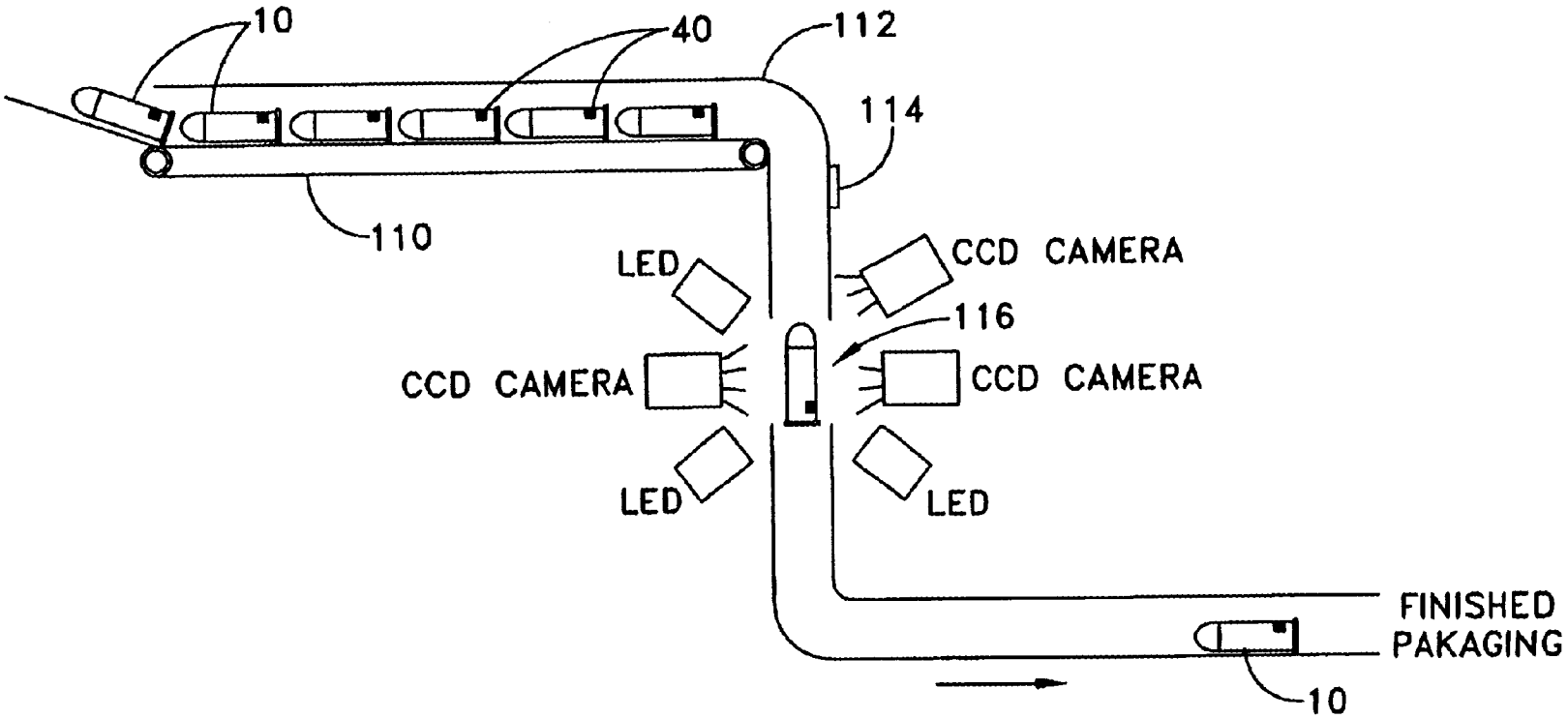
FIG. 13 is a stylized top plan view of a third system for reading coded cartridges.

The second system is a Gravity Fed Horizontal System and is illustrated in FIGS. 11 and 12. Such second system can be described and is designed to collect data from the ammunition casing as the casing by gravity or otherwise rolls down a custom-designed ramp. The system will read, decode and store all coded ammunition whether the code is of a barcode, label or alphanumeric nature. After the ammunition has been coded but before it is placed into the retail package, the finished cartridges will be received onto a preferably rubber-coated ramp 100. The cartridges are placed horizontally on the ramp with the casings touching each other and lined up in the same direction with all primers at one end and the projectile at the other end. As the cartridges roll down the ramp, the rubber coating on the ramp via friction will cause the cartridges to rotate. The cartridges will pass by an illuminated multi-camera system 102. This multi-camera zone will allow multiple rotations of each cartridge within the zone. The angle of the ramp will not be so severe that the cartridges will not rotate too fast for the cameras to decode them. This ramp will vary in length from 2 to 5 feet in length.

FIG. 12 is a top view and illustrates how the rolling action of the casings will expose the code to the cameras. The camera zone will have overlapping fields of view that will ensure the code is exposed to either of the two cameras. In this second reading system, the code applied to the outer casing surface is read by the system.

Software controlling the system ensures complete reading, decoding and storing of data from of each of the cartridges passing the cameras. This gathered information is then sent to the (PLC) computer, which based upon preset parameters, could also record information such as date and lot code as well as all the cartridge identification data. After the system has read, decoded and counted the preset number of cartridges per retail box, the cartridges are allowed to roll onto a following conveyor.

The third reading system is also a multi-camera system. In this sequence, the pre-coded cartridges are placed end to end on a conveyor 110 (see FIG. 13). As the cartridge enters the chute 112, it passes a sensor 114 that will trigger special lighting. An opening 116 is present in the guide chute. Special lighting and three CCD cameras that will provide a 360-degree view of the cartridge as it passes through the opening will surround this opening. The opening is present to prevent distortion of the code for the cameras. The cameras will read, decode and store the cartridge's identity as it passes through the camera zone. The opening is preferably of a length considerably less than that of the cartridge to reduce the possibility of a cartridge falling out thereof.

After the cartridge has passed through the zone and its code read, the cartridge will make a right 90 degree turn and become horizontal once more onto a conveyor and on to the packaging area. The code read in this case is on the outer surface of the casing.

Software controlling the system ensures complete reading, decoding and storage of each of the cartridges passing the camera zone. This gathered information is then sent to the (PLC) computer, which based upon preset parameters, could also record information such as date and lot code as well as all the cartridge identification data. After the system has read, decoded and counted the preset number of cartridges per retail box, the cartridges are allowed onto a following conveyor.

Figure 14:
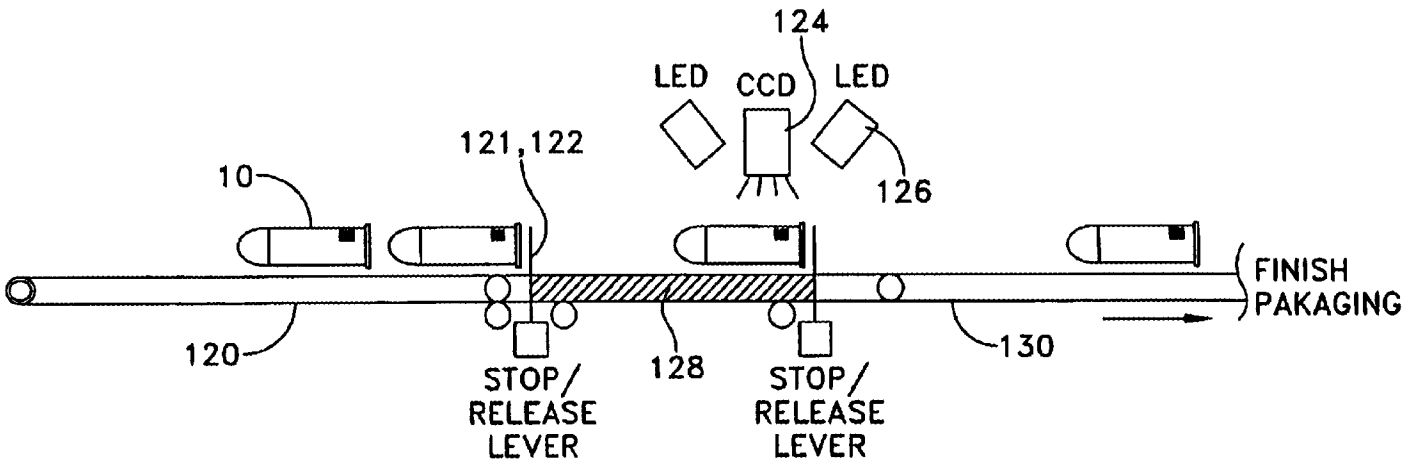
FIG. 14 is a stylized elevational view of a fourth system for reading coded cartridges.
Figure 15:
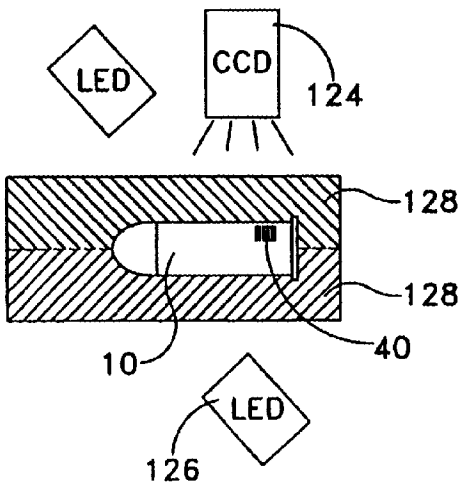
FIG. 15 is an enlarged top view of a portion of the reading system shown in FIG. 14.

The fourth system is a single camera system as shown in FIG. 14 where the finished and coded cartridges are placed on a first conveyor 120 horizontally end-to-end. Product motion sensor 121 will trigger a stop release lever 122 to allow one cartridge at a time to proceed into the scanning zone. The release/stop lever will hold the following cartridges in place on the conveyor. The scanning zone consists of one CCD camera 124 and multiple LED lights 126. As shown in FIG. 15, a single cartridge, as it moves down the conveyor 120, is pushed onto a twin roller scan zone by the first conveyor. This zone comprises two rollers 128 in parallel between the first and second conveyors 120 and 130. One of the rollers 128 in the zone is motorized to rotate the cartridge at a preset speed. As the cartridge rotates, the CCD camera system reads, decodes and stores the barcode or alphanumeric tracking information placed on the cartridge sometime during the production phase. The special lighting continuously illuminates the scanning zone. When the CCD camera has read and decoded the information on the cartridge, the information will be sent to the PLC computer center that, in turn, will send a signal to a release stop lever retract 122 and allow the next cartridge into the camera zone. The camera zone rollers will have a cork screw design that will take the cartridge to the end of the rollers where a product stop lever will keep the cartridge in place. When the cartridge is decoded, that is, the code has been read, the stop release lever will retract and allow the cartridge to proceed onto the second conveyor. The second conveyor will bring the cartridges to the final packaging area where the cartridges will be placed into the retail package.

Software controlling the system ensures complete reading, decoding and storage of each of the cartridges passing the camera zone. This gathered information is then sent to the (PLC) computer, which based upon preset parameters, could also record information such as date and lot code as well as all the cartridge identification data. After the system has read, decoded and counted the preset number of cartridges per retail box, the cartridges are allowed onto a following conveyor.

Figure 16:
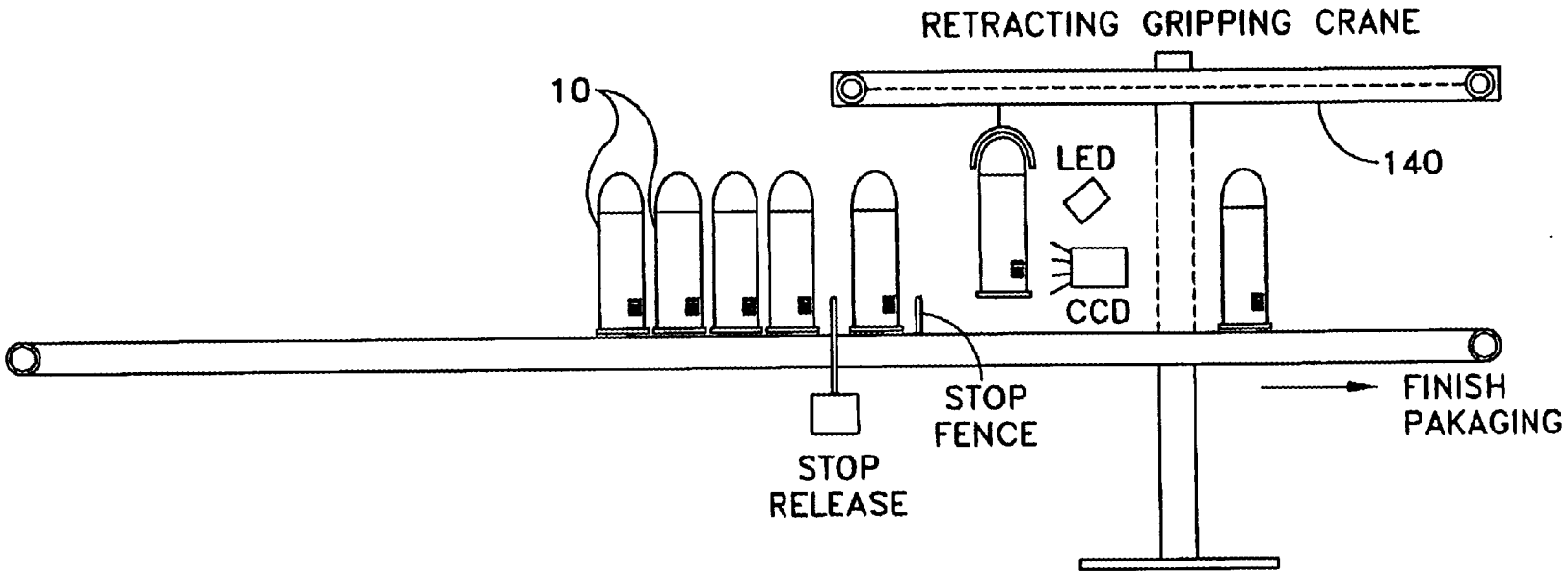
FIG. 16 is a stylized elevational view of a fifth reading system.

The fifth system as shown in FIG. 16 is a single camera system and is designed to pick up a single cartridge from the conveyor. A device 140 will employ a gripping mechanism to pick up the cartridge. An arm of the gripping device will then move the cartridge to the camera zone position. With the camera zone illuminated, the gripping mechanism will rotate the cartridge in the camera zone. When the cartridge has been successfully read and decoded, the gripping mechanism will lower the cartridge onto the same conveyor or onto a different conveyor, release the cartridge and allow the cartridge to proceed to the finished packaging area. The device repeats this procedure unless otherwise notified by the PLC computer. The gripping mechanism resembles a miniature cargo crane and functions in much the same manor. Suitable devices termed "pick and place devices" are commercially available, e.g., see U.S. Pat. No. 4,095,699 to O'Neill.

Software controlling the system ensures complete reading, decoding and storage of each of the cartridges passing the camera zone. This gathered information is then sent to the (PLC) computer, which based upon preset parameters, could also record information such as date and lot code as well as all the cartridge identification data. After the system has read, decoded and counted the preset number of cartridges per retail box, the cartridges are allowed onto a following conveyor.

In each of the above-described five alternate systems for reading the information placed on the cartridge, the cartridge is then transported to a loading conveyor where the cartridges are brought to the packaging area where they will be kept together and put into the retail package. When the cartridges are completely in the retail box, a sensor will trigger the computer-controlled print and apply label machine to apply a label to the package as sown in, FIG. 10. This label will contain all the cartridge ids (identification data) as well as any other pertinent information such as date and lot code, and this label is scanned at the retailer location when the customer purchases the package of cartridges.

The building of shipping cases is also illustrated in FIG. 7 as the packages of complete cartridges are being packed, the package barcode numbers are then scanned and the shipper case is built. The Ammunition Tracking System software program will store all package identifications being placed in the shipping case. After a preset number of packages have been reached to complete the case, a barcode will be printed and applied to the shipping case—this process may be done automatically. The Ammunition Tracking System is used to link this shipper case barcode and all cartridges contained within the case to the distributor or retailer during shipment from the manufacturer.

A pallet is built in the same fashion. After a preset number of cases have been placed on a palette, the Ammunition Tracking System will assign and print a palette label. This palette label when scanned will link every case, package and cartridge's identification to its destination. FIG. 10 in diagram format shows the manner in which the Ammunition Tracking System tracks the ammunition.

Scanning a Palette, Case or Retail Package to the Retailer

When ammunition is shipped to a distributor or retailer, the manufacturer will normally generate an order and picking list from their existing system. Using a data collector device equipped with the Ammunition Tracking System software, the manufacturer will enter the retailer or distributor identification number followed by the invoice number (these steps are covered by trained ammunition tracking personnel). The order picker is then prompted to scan the palettes, cases or retail package selected to fill the order. When the order is complete, the same procedure will be repeated to fill the next order and so on. At the end of the day or any scheduled time/quantity interval, the data collectors are uploaded to the central database server of the Ammunition Tracking System that will continually update this offsite central database. The distributor shipping to the retailer would use the same shipping method utilized by the manufacturer to ship to a distributor.

How the Ammunition Tracking System is used to track cartridges to a customer from the retailer to the consumer is as follows:

When the retailer sells any ammunition cartridges to a consumer, the retailer will enter via an icon from the main menu or the point-of-sale software that may have a pre-programmed key that will collect that ammunition and customer data. By selecting the pre-programmed key, the point-of-sale software will prompt the retailer for the customer's state-approved form of identification. Based on the guidelines of each state, more or less detailed information will be entered such as name, address and driver's license number. In the event the purchase is made via credit card, all personal information will be gathered from that source. Once the required information has been entered, the retailer can then scan any cases or retail boxes of ammunition. With the process complete, the cartridges' identification numbers are now linked to the ultimate customer along with the date, time and retailer of record. In the case of the direct online Internet connection, the transaction is instantly recorded. In the case of the retailer using an onsite computer to collect the data, this computer will be polled at the end of each business day or other interval and all transactions will be uploaded to the centralized database. The preferred system would be the instant online hookup.

Tracking Ammunition Involved in a Crime

Ammunition casings found at crime scenes may be decoded in a number of ways. In the case of the code being of a barcode technology, the casing may be decoded by using a single camera vision system and utilizing windows-base programs, it will be possible to read and decode the barcode thus retrieving the tracking number placed on the casing during manufacturing. In the event the code is of an alphanumeric nature, the code can be retrieved without special equipment. Also, note the possibility of there being a matching code on the inside of the casing. This redundant code is recommended to ensure survivability of said tracking number. The decoded manufacturer tracking number is entered into the Ammunition Tracking System central database by law enforcement agencies at the scene or some central location linked by telephone or computer. Immediately, the ammunition is then traced back to the customer who purchased the ammunition along with the date and retailer as well as all pertinent information collected. It is preferred that any casing at a crime scene be returned to the law enforcement lab to perform this task.

The devices and equipment referred to herein and partially listed on Page 18 hereof are readily available commercially; e.g., OCR devices are commonly used in barcode and computer flatbed scanners; PLC are found in everyday computers with system control software to control conveyors, scanners, printers, etc.; CCD are found in the latest video and all digital cameras—also the latest barcode scanners use this technology; LED (light emitting diode) are used in clocks, cable TV boxes, etc. The above devices can be purchased at Radio Shack, Staples and computer and electrical supply stores.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. The method of coding small arms ammunition cartridges having a hollow cylindrical casing having inner and outer wall surfaces including a closed bottom wall having an outer surface, a bullet projectile attached to the forward end of the casing, an explosive charge included in the interior of the casing and a primer to activate the charge positioned on said bottom wall, comprising providing the outer cylindrical wall surface of the casing with a machine-readable code which code identifies such cartridge, assembling said cartridges in an assembly area and moving and orienting said cartridges seriatim into a lighted code reading station including code reading software such that said code is visible to an optical vision system, reading and decoding such code as the cartridges pass through said code reading station, assigning said cartridges a unique tracking number, thereafter placing a number of such cartridges in a retail package and thereafter applying such unique tracking numbers onto said package so that such numbers may be traced to the ultimate purchaser of such package by reading a casing of one of such cartridges when recovered at a crime scene, and, wherein said cartridges are assembled longitudinally side by side in said assembly area and thereafter rolled into said lighted code reading station wherein the resultant turning of the individual cartridges enables the code to be read by the optical vision system.

2. The method of coding small arms ammunition cartridges having a hollow cylindrical casing having inner and outer wall surfaces including a closed bottom wall having an outer surface, a bullet projectile attached to the forward end of the casing an explosive charge included in the interior of the casing and a primer to activate the charge positioned on said bottom wall, comprising providing at least one exterior wall surface of the casing with a machine-readable code which code identifies such cartridge, assembling said cartridges in an assembly area and moving and orienting said cartridges seriatim into a lighted code reading station including code reading software such that said code is visible to an optical vision system, reading and decoding such code as the cartridges pass through said code reading station, assigning said cartridges a unique tracking number, thereafter placing a number of such cartridges in a retail package and thereafter applying such unique tracking numbers onto said package so that such numbers may be traced to the ultimate purchaser of such package by reading a casing of one of such cartridges when recovered at a crime scene, including providing stop means between the assembly area and the code reading station and wherein said stop means is activated by contact with an upstream cartridge.

* * * * *